US005560059A

United States Patent [19]

McQueen

[11] Patent Number: 5,560,059

[45] Date of Patent: Oct. 1, 1996

[54] PATIENT STRETCHER

[76] Inventor: James A. McQueen, 708 Liberty Dr., Thomasville, N.C. 27360

[21] Appl. No.: 409,007

[22] Filed: Mar. 23, 1995

[51] Int. Cl.[6] ..... A61G 1/00

[52] U.S. Cl. ..... 5/625; 128/870

[58] Field of Search ..... 128/847, 870; 5/625, 628

[56] References Cited

U.S. PATENT DOCUMENTS

| | | | |
|---|---|---|---|
| 4,024,861 | 5/1977 | Vincent | 128/87 |
| 4,034,748 | 7/1977 | Winner | 128/870 X |
| 4,067,075 | 1/1978 | Leathers et al. | 5/82 |
| 4,301,791 | 11/1981 | Franco, III | 128/89 |
| 4,466,145 | 8/1984 | Jones et al. | 5/625 |
| 4,506,604 | 3/1985 | Brault | 128/870 |
| 5,088,137 | 2/1992 | Rose | 5/625 |
| 5,121,756 | 6/1992 | Koledin | 128/870 |
| 5,154,185 | 10/1992 | Latimer | 128/870 |
| 5,154,186 | 10/1992 | Laurin et al. | 128/870 |
| 5,329,934 | 7/1994 | Bowman | 128/845 |

*Primary Examiner*—Michael F. Trettel

[57] ABSTRACT

A stretcher for transporting injured and other persons is provided utilizing a conventional board which has been modified by forming valve stem bores and a pair of depressions therein for receiving inflatable supports. The supports are formed from flexible fluid-impermeable materials such as suitable plastics or elastomerics and include valves and valve stems for filling and releasing the supports with air. Conventional, manual pumps can be utilized by emergency personnel to inflate the support as as needed. The stretcher can be utilized with the supports deflated, partially or fully as required. When inflated, the supports provide maximum comfort and stabilization to the patient who may be kept on the stretcher for extended periods of time during transportation or treatment procedures.

11 Claims, 1 Drawing Sheet

PATIENT STRETCHER

BACKGROUND OF THE INVENTION

1. Field Of The Invention

The invention herein pertains to the immobilization and transportation of sick or injured persons and particularly pertains to the transportation of persons utilizing a stretcher to prevent body movement and possible further injury.

2. Background And Objectives Of The Invention

Stretchers having a rigid board and a pair of underlying skids are commonly used by medical technicians and personnel to transport vehicle accident victims, athletes with sports injuries and other sick and injured persons from the accident site to hospitals and clinics where they undergo examination and treatment. Transportation can take as little as a few minutes, but oftentimes accident victims must remain substantially immobilized for much longer periods, strapped to a rigid stretcher which can cause further discomfort in addition to the injuries suffered. Frequently, accident victims that are not in critical condition must remain on a stretcher atop a hospital gurney during long periods in a hospital corridor before treatment begins. The major contact areas for most patients when strapped to a stretcher are the back of the head, neck and the upper, middle, and rear back portions. These areas become sore and irritated after extended periods while lying immobilized.

Various types of immobilization devices have been utilized in the past which are inflatable, such as set forth in U.S. Pat. No. 4,301,791. This device is used to completely envelope a patient's body. U.S. Pat. No. 5,121,756 provides a vacuum immobilizer and discusses in detail prior attempts at patient immobilization, such as with the use of padding, and air evacuating bags using round beads. U.S. Pat. No. 4,024,861 utilizes a spinal support in the form of an inflatable bag for attachment to a patient during transportation. U.S. Pat. No. 5,329,934 teaches the use of a restraint device utilizing a variety of support cushions positioned at strategic locations along the head and back areas. U.S. Pat. No. 4,067,065 provides a completely inflatable stretcher formed of polymeric or elastomeric coated fabrics.

While such prior art devices provide certain advantages under certain conditions, inherent disadvantages are also realized. For example, in some prior art inflatable devices, there is little or no protection against puncture and damages which can occur, especially at vehicle accident sites when the stretcher or device is placed on the ground for patient loading. Also, certain prior art devices do not maintain an injured patient sufficiently immobile from head to toe, which is often of primary importance when handling patients having spinal injuries. Certain types of vacuum immobilizers require expensive and complicated vacuum-producing systems which are often unavailable or which are difficult to properly use.

With the aforementioned and other disadvantages associated with prior art stretcher devices, the present invention was conceived and one of its objectives is to overcome the shortcomings and problems associated with known devices while providing injury victims with a secure, comfortable means for immobilization and transportation.

It is another objective of the present invention to provide a patient stretcher which combines the rigidity of conventional wood, metal, or plastic stretchers yet has the advantages of a cushioned or inflatable board.

It is yet another ojective of the present invention to provide a patient stretcher which includes a plurality of flexible supports which can be individually, selectively inflated, depending on the particular needs of the patient.

It is still another objective of the present invention to provide a rigid stretcher board in which depressions have been formed for receiving inflatable envelopes for selectively filling with a manual pump.

Various other objectives and advantages of the present invention will become apparent to those skilled in the art as a more detailed description is set forth below.

SUMMARY OF THE INVENTION

A stretcher is provided having inflatable neck and back supports incorporated to increase the patient's comfort, immobilization, and well-being during use. The conventional stretcher board is formed from rigid polymeric materials and has been modified to include a pair of rectangular depressions therein. Removable, inflatable supports in the form of polymeric or elastomeric envelopes are positioned in the depressions. By the use of a manual air pump or the like, extending valve stems deliver air to the supports for selective inflation. The supports can be individually inflated as desired to suitable pressures, depending on the needs of the patient and after use, the supports can be quickly deflated through terminal valves for storage purposes. Hook and loop fasteners or other means for attachment can be used for easy removal for cleaning and sanitation purposes.

DETAILED DESCRIPTION OF THE PREFERRED EMBODIMENT AND OPERATION OF THE INVENTION

Figure 1:
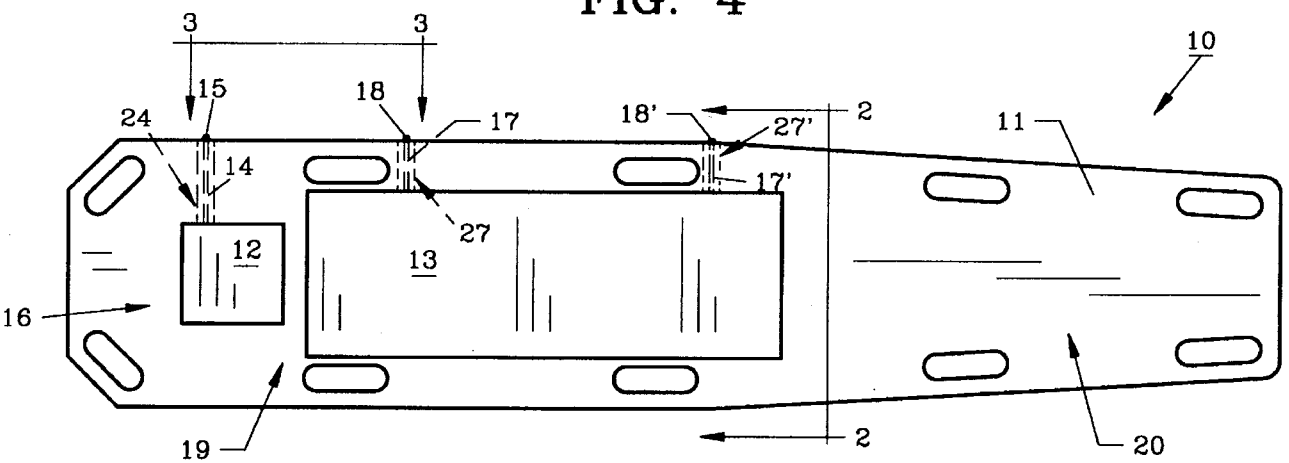
FIG. 1 illustrates a top view of the patient stretcher of the invention with the valve stem shown in hidden form.

For a better understanding of the invention and its use, turning now to the drawings, FIG. 1 demonstrates the preferred form of patient stretcher 10 in an unoccupied, deflated mode. As shown, stretcher 10 includes a rigid conventional polymeric board 11 which has been modified by adding inflatable neck support 12 and inflatable body support 13. Neck support 12 comprises a removable, inflatable envelope formed from a suitable polymeric or elastomeric material and is inflated by air pressure such as with a manual pump or the like (not shown) through valve stem 14. Valve stem 14 includes a terminal valve 15 to prevent air escape. Neck support 12 is positioned in depression 16 formed in the top surface of board 11 with depression 16 approximately one-half inch deep. Board 11 may be, for example, a conventional patient stretcher formed from wood, metal, or a suitable rigid polymeric material as commonly in use. Both neck support 12 and body support 13 can be releasably attached to board 11 by hook and loop fasteners or by other means as desired for easy removal during cleaning or maintenance purposes.

Neck support 12 can be quickly inflated by emergency medical personnel using a small standard hand pump and, when inflated, provides immobilization and comfort to injured or ill patients. It is not uncommon for such patients to rest 1–3 hours on a stretcher during transportation from, for example, an automobile accident to a hospital or clinic. Additionally, patients oftentimes remain on stretchers atop gurneys waiting for medical examinations or other procedures.

Figure 5:
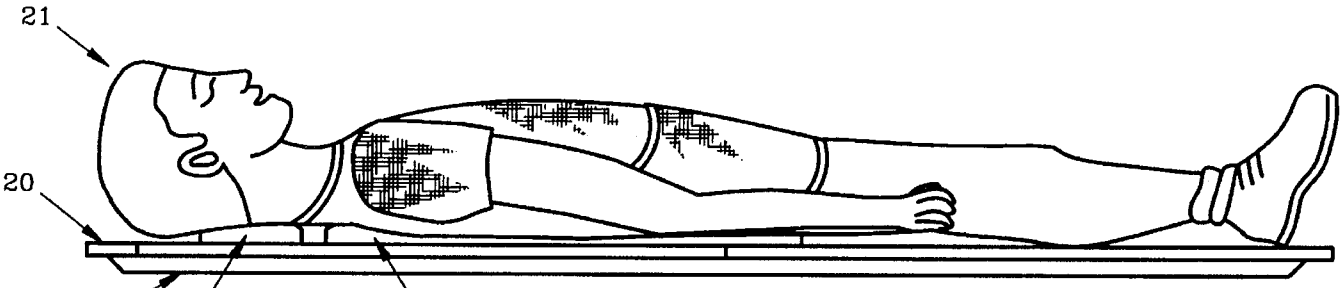
FIG. 5 pictures the stretcher as seen in FIG. 4, but with a patient lying thereon.
Figure 4:
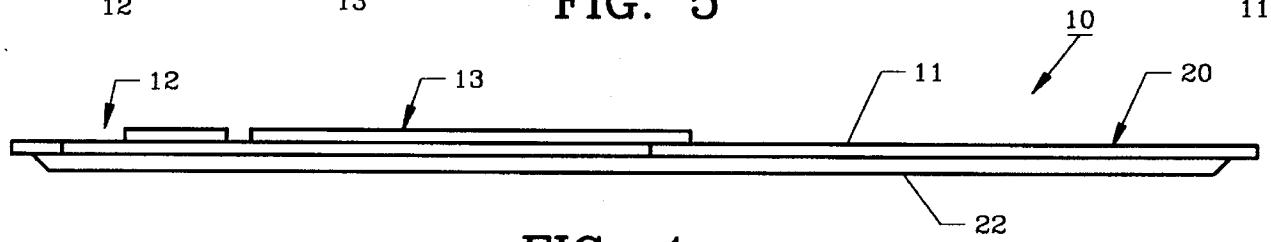
FIG. 4 shows a left side view of the patient stretcher with the neck and body supports inflated.

Body support 13 likewise comprises a removable polymeric or elastomeric envelope which is inflatable through valve stems 17, 17' which pass through bores 27, 27' formed in board 11 shown in FIG. 1. Air is pumped though valves 18, 18' and valve stems 17, 17' into body support 13. Body support 13 is positioned in a large, rectangular depression 19 (FIG. 2) of approximately one-half inch depth in board 11. Upon inflation of body support 13, support 13 then rises to approximately ¾ of an inch above top surface 20 of board 11 as shown in FIG. 4. Thus, as seen in FIG. 5, patient 21 can comfortably rest on stretcher 10 as neck support 12 and body support 13 provide a cushion effect, while stabilizing the patient. As would be understood, patient 21 is generally strapped to stretcher 10 but straps and bindings are not shown in the drawings for clarity purposes. With a patient so strapped to stretcher 10, inflation of supports 12, 13 provide further immobilization as needed.

Figure 2:
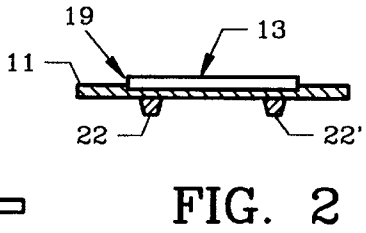
FIG. 2 demonstrates a cross-section of the stretcher seen along lines 2—2 of FIG. 1.
Figure 3:
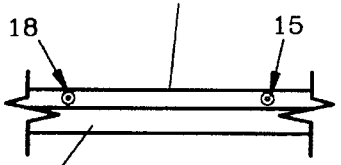
FIG. 3 depicts another section of the stretcher as shown in FIG. 1 along lines 3—3.

A cross-sectional view of inflated body support 13 is shown in FIG. 2 along lines 2—2 of FIG. 1. As seen in FIG. 2, board 11 is affixed to usual skids 22, 22' and depression 19 is seen formed to approximately half the depth of board 11. Body support 13 is shown in an inflated mode. Pneumatic valves 15, 18 shown in FIG. 3 are conventional, as is valve 18', which can be joined to a manual air pump, tank or the like (not seen) for use by medical personnel and technicians. Valve stems 14, 17, 17' are contained within lateral bores 24, 27 and 27' of board 11. Neck support 12 and body support 13 can be inflated through valve stems 14, 17, 17' in a matter of minutes by relatively unskilled personnel by the use of such conventional pumps or tanks.

Stretcher 10 as further shown in FIG. 1 includes two valve stems (17, 17') for inflation of body support 13 although only one such valve stem may be utilized. As neck support 12 and body support 13 are independent, either, both, or neither may be inflated partially or fully, depending on the particular needs of the patient being attended.

The illustrations and examples provided herein are for explanatory purposes and are not intended to limit the scope of the appended claims.

I claim:

1. A stretcher comprising: a rigid board, said board having a top surface, said top surface defining a first depression therein, an inflatable support, and said support contained within said first depression, and said top surface defining a second depression.

2. The stretcher of claim 1 wherein said inflatable support comprises a body support.

3. The stretcher of claim 2 wherein said body support comprises an inflatable envelope.

4. The stretcher of claim 3 wherein said envelope is formed from a polymeric material.

5. The stretcher of claim 1 and including a first valve stem, said valve stem in fluid communication with said inflatable support.

6. The stretcher of claim 1 and including an inflatable neck support, said neck support contained within said second depression.

7. The stretcher of claim 6 and including a second valve stem, said second valve stem in fluid communication with said neck support.

8. The stretcher of claim 7 and including a fluid valve, said fluid valve connected to said second valve stem.

9. A stretcher comprising: a rigid board, said board having a top surface, said top surface defining a pair of depressions therein, said top surface defining a first small depression for containing an inflatable neck support and a second large depression for containing an inflatable body support, an inflatable neck support contained within said first depression, and an inflatable body support contained within said second depression.

10. The stretcher of claim 9 wherein said neck and said body supports are independently inflatable.

11. The stretcher of claim 9 wherein said board defines a lateral valve stem bore.

* * * * *